US005491850A

United States Patent [19]

Kiester

[11] Patent Number: 5,491,850

[45] Date of Patent: Feb. 20, 1996

[54] BATHTUB-MOUNTED INFANT SUPPORT SYSTEM

[76] Inventor: Ben Kiester, 1641 Crescent Pl., Venice, Calif. 90291

[21] Appl. No.: 308,283

[22] Filed: Sep. 19, 1994

[51] Int. Cl.[6] ..... A47K 3/024

[52] U.S. Cl. ..... 4/572.1; 4/579

[58] Field of Search ..... 4/571.1–575.1, 4/578.1, 579

[56] References Cited

U.S. PATENT DOCUMENTS

| | | | |
|---|---|---|---|
| 1,450,827 | 4/1923 | Wood | 4/573.1 |
| 1,734,462 | 11/1929 | Gottlieb | 4/572.1 |
| 2,607,925 | 8/1952 | DePuy | 4/572.1 X |

FOREIGN PATENT DOCUMENTS

| | | | |
|---|---|---|---|
| 0673554 | 3/1939 | Germany | 4/572.1 |

*Primary Examiner*—Charles E. Phillips
*Attorney, Agent, or Firm*—Erik M. Arnhem

[57] ABSTRACT

A portable infant support system is provided for installation in a conventional bathtub so that an infant can be supported in a prone position above the tub water level while the mother is washing or bathing the infant. The support system includes a flexible foam rubber panel suspended within the tub by four or more suction cups at the corners of the panel. Each suction cup is adherred to an internal side surface of the tub to suspend a portion of the panel. The suction cups can be slid along the tub side surface to adjust to the position of the foam panel.

4 Claims, 2 Drawing Sheets

BATHTUB-MOUNTED INFANT SUPPORT SYSTEM

BACKGROUND OF THE INVENTION

1. Field of the Invention

This invention relates to a hammock-type support system for an infant, and especially to a portable hammock-type support system installable in a conventional bathtub for supporting an infant in a prone position at, or above, the water level in the bathtub.

2. Prior Developments

Bathing or washing an infant child in a bathtub is difficult because there is the possibility that the infant will break loose from the mother's grasp and strike his or her head on the hard bathtub surface, with consequent possibility of injury.

There are apparently no devices currently available for safely positioning a small infant in a bathtub for washing or bathing purposes.

SUMMARY OF THE PRESENT INVENTION

The present invention relates to an infant support system that can be installed in a conventional bathtub for safely supporting the infant in an elevated position above the hard floor surface of the tub. A preferred form of the invention comprises a flexible rectangular panel having suction cups at the panel corners; additional suction cups can be provided along the side edges of the panel. The width of the flexible panel is slightly less than the corresponding internal width dimension of a conventional bathtub, so that when the suction cups are adherred to the internal side surfaces of the tub, the flexible panel will be suspended above the floor (or bottom wall) of the tub. An infant can be placed on the flexible panel in a prone position, while the mother bathes or washes the infant.

The flexible panel will be centrally depressed to a slight extent, under the weight of the infant, thereby tending to keep the infant within the depressed area of the panel, so that the infant is prevented from falling onto the floor of the tub. The support action of the flexible panel resembles that of a hammock.

The aforementioned suction cups are detachably connected to the flexible panel, so that when the suction cups are removed from the panel, the panel can be used as a pad underneath the infant during a diaper-changing operation. The pad is preferably formed of a closed cell foam material e.g. Neoprene, with a pad thickness in the neighborhood of five millimeters (about one quarter inch). The pad is thick enough to provide a soft comfortable surface for the baby, while the diaper is being changed.

The infant support system of this invention is usable with conventional bathtubs, without need for modifying the tub or special tools in order to install the support system in the tub. When the support system is not in use, it can be stored in a compact, rolled-up condition.

THE DRAWINGS

DESCRIPTION OF A PREFERRED EMBODIMENT OF THE INVENTION

Figure 1:
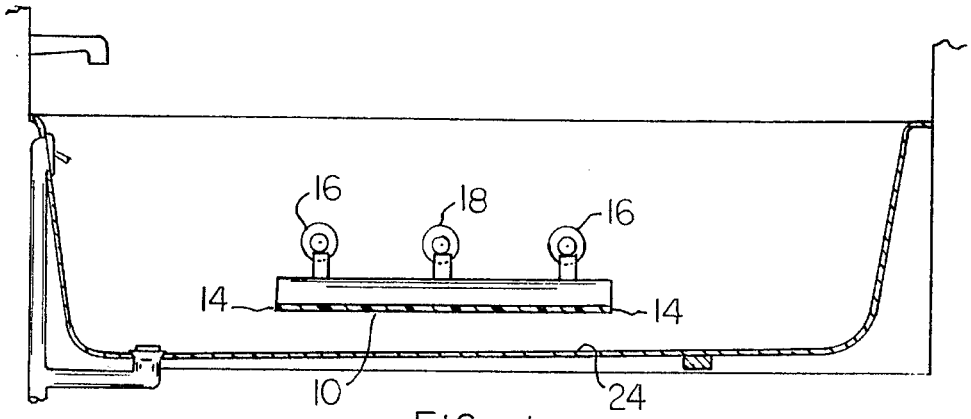
FIG. 1 is a longitudinal sectional view taken through a conventional bathtub, with an infant support system installed therein.
Figure 2:
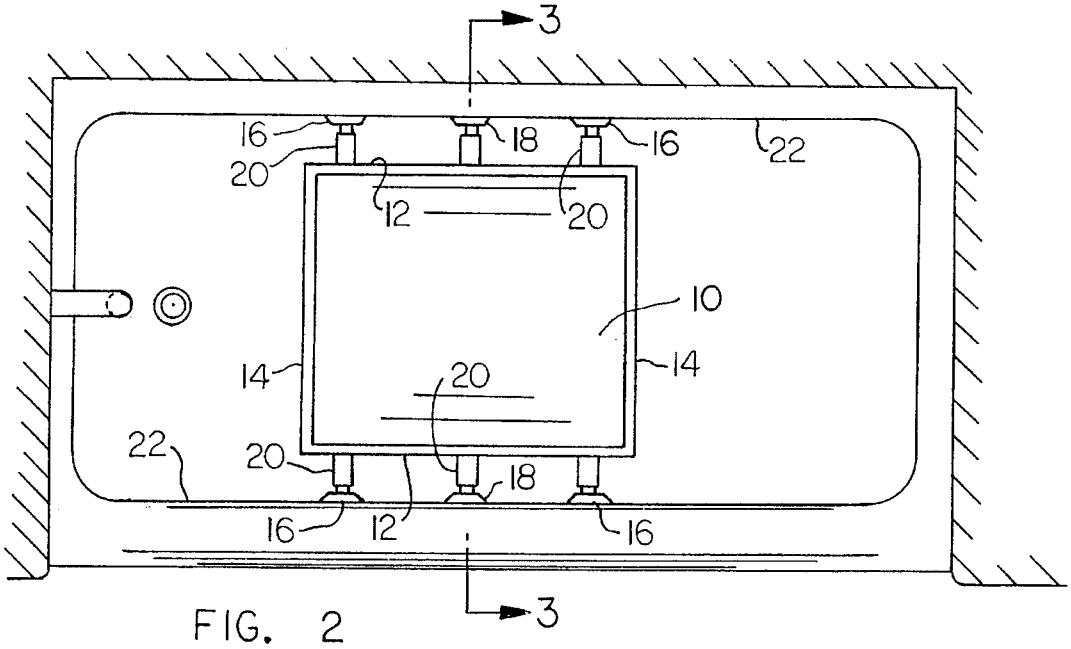
FIG. 2 is a top plan view of the FIG. 1 bathtub and infant support system.
Figure 3:
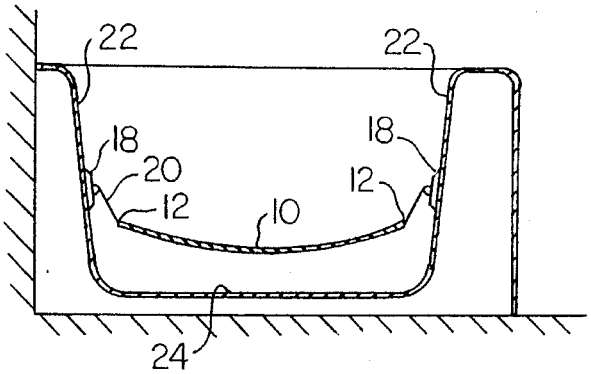
FIG. 3 is a transverse sectional view taken on line 3—3 in FIG. 2.

FIGS. 1 through 3 show a conventional bathtub having an infant support system of the present invention installed therein. When the infant support system is not in use, it can be removed from the bathtub, such that the tub can be used in normal fashion. The infant support system is portable.

The infant support system comprises a rectangular flexible panel 10 having two side edges 12 and two end edges 14. The four edges intersect to form four panel corners. A suction cup 16 is provided proximate to each corner of the panel. Additionally two suction cups 18 may be provided along the side edges of the panel, approximately midway between the corner suction cups.

Figure 4:
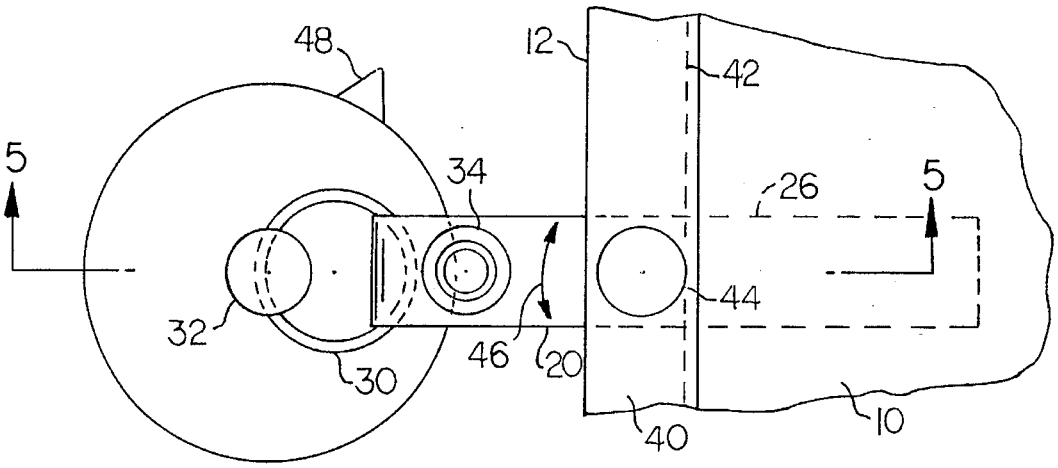
FIG. 4 is an enlarged view of a suction cup and connector means used in the infant support system of FIG. 1.
Figure 5:
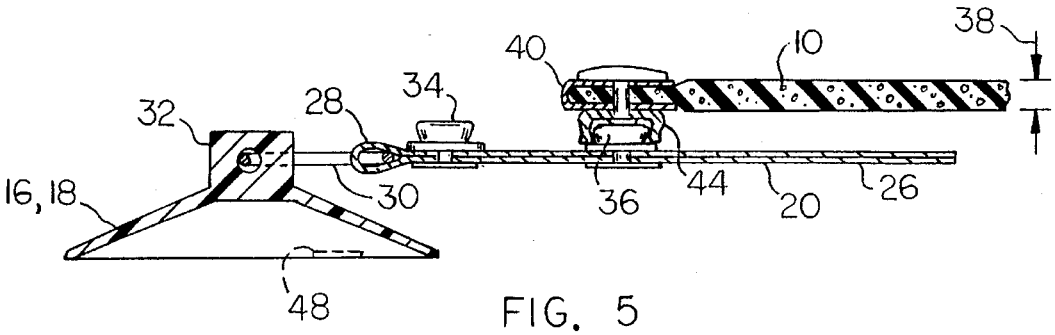
FIG. 5 is a sectional view taken on line 5—5 in FIG. 4.

Each suction cup 16 or 18 is connected to flexible panel 10 by a flexible connector means 20. The detailed construction of a representative connector means is illustrated in FIGS. 4 and 5. All of the connector means 20 are the same, so that FIGS. 4 and 5 apply to anyone of the connector mechanisms.

Referring to FIGS. 1 through 3, the suction cups 16 and 18 are adherred to the internal side surfaces 22 of the bathtub, such that flexible panel 10 is suspended above the floor 24 of the tub. A small infant can be placed on the panel, either on his (her) back or stomach, so that the mother can wash or bathe the infant without danger that the infant will fall onto the hard tub floor 24, or possibly become submerged in the water in the tub. The water level in the tub is selected so as to be slightly below the level of panel 10. If desired, the water level can be approximately in the plane of panel 10, such that the infant (baby) can splash in the water while not being submerged.

The weight of the baby will cause the central portion of panel 10 to be depressed, such that the panel tends to act as a cradle or hammock partially surrounding the baby. This tends to keep the baby from falling out of the panel space.

Suction cups 16 and 18 are applied manually to the tub side surfaces 22. After any given suction cup is adherred to tub surface 22 it can be slid along surface 22 to any desired position, for optimal positionment of panel 10 relative to floor 24 or the water level in the tub. If desired, the corner suction cups 16 can be slightly elevated, in relation to suction cups 18, so as to raise the corner areas of panel 10. Such action tends to produce a cradling action that keeps the infant in the space above the panel. Panel 10 is flexible so that it can have a hammock-like configuration.

Referring to FIGS. 4 and 5, a representative connector means 20 comprises a flexible fabric strap 26 having a double wall character, such that a loop section 28 of the strap extends around a section of a circular metal ring 30. Ring 30 extends through a transverse opening in a plug portion 32 of the suction cup 16, or 18, such that ring 30 acts as an articulation joint or pivotal link between strap 26 and the suction cup. The suction cup can assume various orientations without producing any binding or interference between ring 30 and strap 26.

The two walls (or layers) of strap 26 are locked together by two male snap fastener elements 34 and 36 spaced along the length of the strap; snap fastener elements 34 and 36 are preferably spaced apart about one or one and one half inch.

As fragmentarily shown in FIGS. 4 and 5, flexible panel 10 is formed out of an elastomeric foam sheet having a closed cell character, whereby the sheet is resistant to penetration by water. The foam sheet is however quite soft and flexible so as to be comfortable for the baby; the upper surface of the sheet may be covered with a thin woven nylon cloth material for appearance purposes. The thickness dimension 38 of the foam sheet is preferably about five millimeters (one quarter inch).

The edge area of the elastomeric foam sheet is preferably covered with a heavy wear-resistant edging strip 40, sewn to the foam material by stitching 42 (FIG. 4).

A female snap fastener element 44 is affixed to the edge area of panel 10 for selective interlocking snap engagement with mating snap fastener elements 34 and 36, whereby the connector means can be unfastened from panel 10 if so desired. With the various connector mechanisms 20 disconnected from panel 10, the panel can be used as a soft comfortable support surface or pad for the baby while the mother is changing the baby's diaper. Panel 10 has dual usage.

Each snap fastener element 34, 36 and 44 has a circular plan configuration, whereby the flexible strap 26 can be swung around the axis of the interlocked snap fastener elements, as denoted by arrow 46 in FIG. 4. Such arcuate adjustment of the strap may be advantageous during manipulation of the suction cups along the tub surfaces 22.

The use of multiple snap fastener elements 34 and 36 is for the purpose of varying the spacing of the suction cup from the proximate edge of panel 10. As, shown in FIG. 5, snap fastener element 36 is utilized so that the suction cup is relatively far away from the edge of panel 10. When the other snap fastener element 34 is interlocked with female element 44, the suction cup is brought closer to the panel edge.

Adjusting the suction cups, closer or further away from, the edge of the panel permits some variation in the sag or droop of panel 10 as viewed in FIG. 3). The suction cup system is readily usable for panel suspension purposes, without tools or special skill. The suction cups are easily applied to and removed from the bathtub surfaces. Each suction cup can be provided with a pull tab 48 to facilitate separation of the suction cup from the bathtub surface.

The suction cups are removed from the flexible panel 10, such that the panel can be used as a pad underneath the baby during diaper-changing operation.

The support system, according to the invention, can be removed, installed or adjusted with little effort, permitting easy and safe access to the infant during the washing or bathing in the bathtub. When using said system, the infant will not be exposed to rough surfaces that could injure the infant's skin.

What is claimed is:

1. A portable support system for an infant located in a bathtub, comprising:

a flexible panel having two side edges and two end edges; said side edges intersecting said end edges to form four panel corners;

a suction cup located proximate to each corner of said panel, and a flexible connector means extending from said panel to each suction cup, whereby each suction cup constitutes a suspension means for the respective corner area of the panel;

the side edges of said panel being spaced apart a slightly lesser distance than the internal side surfaces of a conventional bathtub, whereby the flexible panel can be suspended within the bathtub by affixing the suction cups to the internal side surfaces of the tub;

each said flexible connector means comprising a strap extending from the panel, and a circular ring joining the strap to the associated suction cup, each circular ring forming a pivotable link between the respective strap and suction cup; and a detachable fastening means between each strap and said panel; each said fastening means comprising a male snap fastener element on the respective strap, and a mating female snap fastener element on said panel; said fastener elements having circular configurations, whereby the associated strap can swivel around the fastener element axis for optimal positionment of the associated suction cup.

2. A portable support system for an infant located in a bathtub, comprising:

a flexible panel having two side edges and two end edges; said side edges intersecting said end edges to form four panel corners;

a suction cup located proximate to each corner of said panel, and a flexible connector means extending from said panel to each suction cup, whereby each suction cup constitutes a suspension means for the respective corner area of the panel;

the side edges of said panel being spaced apart a slightly lesser distance than the internal side surfaces of a conventional bathtub, whereby the flexible panel can be suspended within the bathtub by affixing the suction cups to the internal side surfaces of the tub;

each said flexible connector means comprising a strap extending from the panel, and a circular ring joining the strap to the associated suction cup, each circular ring forming a pivotable link between the respective strap and suction cup; and a detachable fastener means between each strap and said panel; each said fastener means comprising two male snap fastener elements mounted at spaced points along the respective strap, and a single mating female snap fastener element on said panel; each said female snap fastener element being selectively engageable with the associated male snap fastener elements for adjustment of the distance from the side edge of the panel to the respective suction cup.

3. The infant support system of claim 2, wherein said snap fastener elements have circular configurations, whereby the associated strap can swivel around the axis of the engaged fastener elements for optimal positionment of the associated suction cup.

4. A portable support system for an infant located in a bathtub, comprising:

a flexible panel having two side edges and two end edges; said side edges intersecting said end edges to form four panel corners;

a suction cup located proximate to each corner of said panel, and a flexible connector means extending from said panel to each suction cup, whereby each suction cup constitutes a suspension means for the respective corner area of the panel;

the side edges of said panel being spaced apart a sightly lesser distance than the internal side surfaces of a conventional bathtub, whereby the flexible panel can be suspended within the bathtub by affixing the suction cups to the internal side surfaces of the tub;

said flexible panel being formed of a sheet of elastomeric closed cell foam material having a thickness of approximately five millimeters.

* * * * *